US008727520B2

(12) United States Patent
Ozawa

(10) Patent No.: US 8,727,520 B2
(45) Date of Patent: May 20, 2014

(54) LIQUID EJECTING METHOD AND LIQUID EJECTING APPARATUS

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 373 days.

(21) Appl. No.: 13/049,224

(22) Filed: Mar. 16, 2011

(65) Prior Publication Data

US 2011/0228023 A1 Sep. 22, 2011

(30) Foreign Application Priority Data

Mar. 18, 2010 (JP) ..... 2010-062166

(51) Int. Cl.
*B41J 2/01* (2006.01)

(52) U.S. Cl.
USPC ..... 347/96; 347/98; 347/100; 347/11; 347/15

(58) Field of Classification Search
CPC ..... B41J 2/01; B41J 2/2114; B41J 2/2117; B41J 2/07; B41J 2/04595
USPC ..... 347/11, 15, 21, 28, 95–100; 523/160, 523/161; 106/31.13, 31.27, 31.6
See application file for complete search history.

(56) References Cited

U.S. PATENT DOCUMENTS

| | | | | |
|---|---|---|---|---|
| 6,431,671 | B2 * | 8/2002 | Matsumoto | 347/7 |
| 6,582,054 | B2 * | 6/2003 | Yamamoto et al. | 347/21 |
| 6,863,392 | B2 * | 3/2005 | Shimomura et al. | 347/100 |
| 7,891,799 | B2 * | 2/2011 | Edwards et al. | 347/100 |
| 7,992,989 | B2 * | 8/2011 | Makuta et al. | 347/100 |
| 8,033,660 | B2 * | 10/2011 | Nakazawa et al. | 347/102 |
| 8,118,401 | B2 * | 2/2012 | Yoshida | 347/43 |
| 8,192,010 | B2 * | 6/2012 | Edwards et al. | 347/100 |
| 8,220,917 | B2 * | 7/2012 | Taniuchi et al. | 347/103 |
| 8,317,311 | B2 * | 11/2012 | Edwards et al. | 347/96 |
| 8,419,177 | B2 * | 4/2013 | Ozawa | 347/100 |
| 8,430,498 | B2 * | 4/2013 | Edwards et al. | 347/100 |
| 8,439,466 | B2 * | 5/2013 | Tanoue et al. | 347/12 |
| 2005/0168503 | A1 * | 8/2005 | Mitsuzawa | 347/5 |
| 2006/0017760 | A1 * | 1/2006 | Matsuzawa et al. | 347/15 |
| 2006/0017761 | A1 * | 1/2006 | Matsuzawa et al. | 347/15 |
| 2006/0227159 | A1 * | 10/2006 | Nakajo | 347/15 |
| 2007/0076069 | A1 * | 4/2007 | Edwards et al. | 347/100 |
| 2009/0220695 | A1 | 9/2009 | Oyanagi et al. | |
| 2011/0227984 | A1 * | 9/2011 | Onishi | 347/16 |
| 2013/0021401 | A1 * | 1/2013 | Okuda et al. | 347/15 |

FOREIGN PATENT DOCUMENTS

| | | |
|---|---|---|
| JP | 2000-141708 | 5/2000 |
| JP | 2009-126071 | 6/2009 |
| JP | 2009-269397 | 11/2009 |

* cited by examiner

*Primary Examiner* — Matthew Luu
*Assistant Examiner* — Rut Patel
(74) *Attorney, Agent, or Firm* — Workman Nydegger

(57) ABSTRACT

After one ink of a white ink or a silver ink is ejected in a predetermined position of a recording medium such as a piece of recording paper to form a base layer, the other ink thereof is ejected on the base layer to form an intermediate layer, and a clear ink is ejected on the intermediate layer to form an epidermal layer.

10 Claims, 8 Drawing Sheets

LIQUID EJECTING METHOD AND LIQUID EJECTING APPARATUS

CROSS REFERENCES TO RELATED APPLICATIONS

The entire disclosure of Japanese Patent Application No. 2010-62166, filed Mar. 18, 2010 is expressly incorporated herein by reference.

BACKGROUND OF THE INVENTION

1. Technical Field

The present invention relates to a liquid ejecting method for use in a liquid ejecting apparatus including, for example, an ink jet type recording head, and a liquid ejecting apparatus.

2. Related Art

In liquid ejecting apparatuses currently known in the art, printers are configured to perform various applications using a special color of ink in addition to black (K), cyan (C), magenta (M), and yellow (Y) that are colors becoming the basis of the formation of text or images. For example, a printer disclosed in Japanese Patent Document JP-A-2009-126071 is configured so that the recording can be performed using a white ink including a white pigment or a silver ink including a metal pigment. By performing the recording of the image or the like using the white ink or the silver ink, a wider range of color expression is possible.

Unfortunately, however, a recording method currently used with such inks is less efficient than other printers. As such there is a need for an apparatus configuration thereof that is more effective when using the additional ink, such as white ink or silver ink.

BRIEF SUMMARY OF THE INVENTION

A liquid ejecting method according to an embodiment of the present invention includes ejecting one liquid of a white-based liquid or a gloss-based liquid from a liquid ejecting head which ejects liquid from nozzles of a nozzle row, the one liquid being ejected to a predetermined position of a landing object to form a base layer; ejecting the other liquid of the white-based liquid or the gloss-based liquid on the base layer to form an intermediate layer; and ejecting a translucent clear liquid on the intermediate layer to form an epidermal layer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for carrying out the invention will be described with reference to the drawings. In addition, in the embodiment described later, various limitations as desirable specific examples of the invention exist, but the scope of the invention is not limited to these aspects unless there is a description to the effect that the invention is limited in the following description. In addition, in the present embodiment, an image recording apparatus that is a form of a liquid ejecting apparatus, specifically, an ink jet type printer (hereinafter, referred to as a printer) with an ink jet type recording head (hereinafter, simply referred to as a recording head) as a liquid ejecting head mounted thereon will be described by way of example.

In addition, in the following description, the term "white-based" means a color that is visually recognized as white, and means that, for example, white with a slight hint of color known as off-white or ivory white is also included without being limited to white of an achromatic color.

Moreover, in the following description, the term "gloss-based liquid" means a liquid that includes a metallic powder, a pearl powder or the like as a pigment and allows visual recognition of the glossy feeling through the reflection of light by the pigment.

Furthermore, in the following description, the term "translucent clear liquid" means a liquid that is colorless (that is not actively colored) and through which light penetrates.

Figure 1:
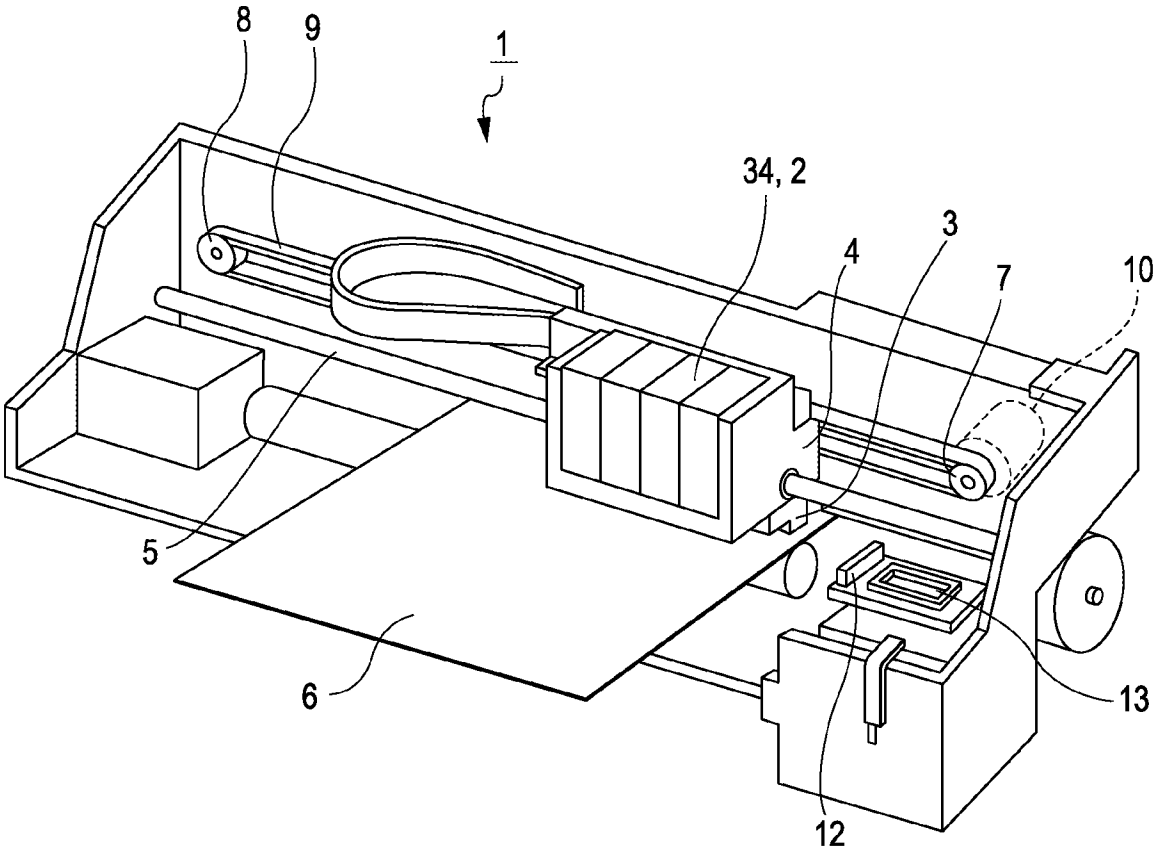
FIG. 1 is a perspective view that illustrates a configuration of a printer according to an aspect of the invention.

Firstly, the overall structure of a printer 1 will be described based on FIG. 1. The exemplified printer 1 has a carriage 4 on which a cartridge mounting portion 2 and a recording head 3 (a kind of liquid ejecting head of the invention) are provided. The carriage 4 is pivotally supported on a guide rod 5 and is mounted movably in a width direction (a main scanning direction) of a piece of recording paper 6. A timing belt 9 spanning between a driving pulley 7 and a free rolling pulley 8 is connected to the carriage 4. In addition, the driving pulley 7 is joined to a rotational axis of a pulse motor 10. Thus, the carriage 4 moves in a width direction of the recording paper 6 (that is a kind of recording medium and a kind of landing object in the invention) by the operation of the pulse motor 10. In one end portion area within the movement range of the carriage 4, a home position is set, is the home position being situated at the time of standby in which the recording head 3 does not perform the recording operation relative to the recording paper 6. A wiper mechanism 12 for cleaning a surface of a nozzle plate 11 (see FIG. 2) of the recording head 3, and a capping mechanism 13 capable of sealing the nozzle forming surface are disposed in the home position.

Figure 2:
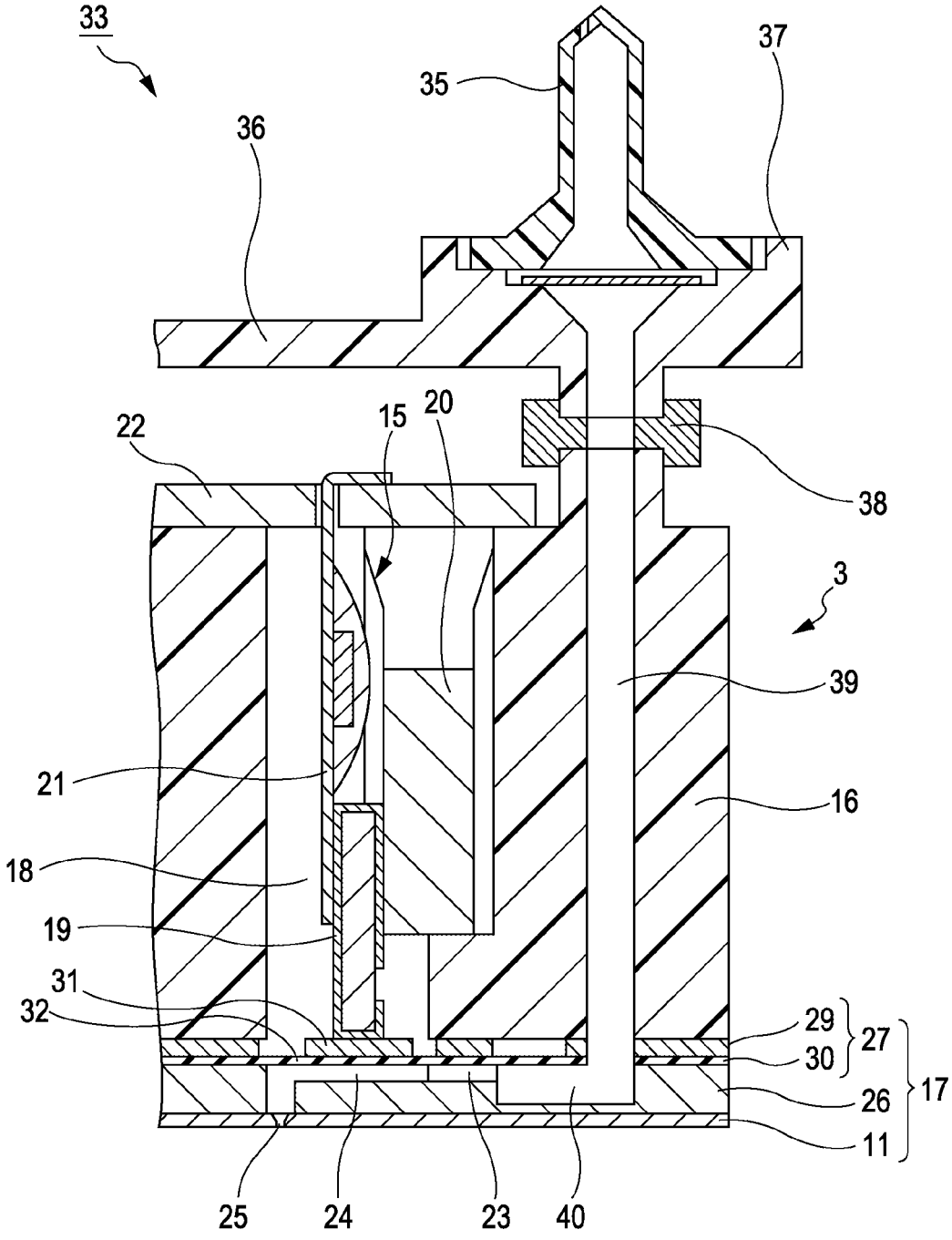
FIG. 2 is a partial enlarged cross-sectional view of a recording head according to an aspect of the invention.

As the recording head, recording heads of various configurations can be used, but, in the present embodiment, the recording head 3 shown in FIG. 2 is mounted on the printer 1. The recording head 3 includes a vibrator unit 15, a case 16 capable of receiving the vibrator unit 15 therein, a flow path unit 17 that is joined to a front end surface of the case 16 or the like.

The case 16 is a block-shaped member having a receiving space portion 18 for receiving the vibrator unit 15 therein and is produced, for example, by molding resin (epoxy resin or the like). The vibrator unit 15 includes a plurality of piezoelectric vibrators 19 formed in the shape of comb teeth, a fixing plate 20 to which each piezoelectric vibrator 19 is joined, and a flexible cable 21 for supplying a drive signal or the like to each piezoelectric vibrator 19.

The piezoelectric vibrator 19 is a kind of pressure generating unit. The piezoelectric vibrator 19 of the present embodiment is a stacked type piezoelectric vibrator that is produced, for example, by separating the piezoelectric plate, in which a piezoelectric layer and an electrode layer are alternately stacked over each other, in the shape of comb teeth, and is a piezoelectric vibrator of a longitudinal vibration mode capable of stretching in a direction perpendicular to a stacked direction.

The fixing plate 20 is a plate material made of metal that can accept the reaction from the piezoelectric vibrator 19. The flexible cable 21 is a film-shaped wiring member having the flexibility. In addition, a terminal portion of one end side of the flexible cable 21 is soldered to a terminal portion of the piezoelectric vibrator 19, and a terminal portion of the other side thereof is soldered to a terminal portion of a wiring substrate 22.

Upon applying the electric field to the piezoelectric layer constituting the piezoelectric vibrator 19, that is, upon supplying the drive signal via the flexible cable 21, the free end portion stretches in an element length direction (a direction perpendicular to the stacked direction). For example, when the electric potential of the vibrator is raised by the charging, the piezoelectric vibrator 19 contracts in the element length direction, and when the vibrator electric potential is dropped by the discharging, the piezoelectric vibrator 19 stretches in the element length direction.

The flow path unit 17 is a plate-shaped member having a series of individual liquid flow paths that lead from a liquid supply hole 23 via a pressure chamber 24 to a nozzle 25. The flow path unit 17 includes a flow path forming substrate 26 having a space portion, a groove portion or the like becoming the pressure portion 24 or the liquid supply hole 23, an elastic plate 27 that seals the opening of the space portion or the groove portion to partition a part of the pressure chamber 24 or the liquid supply hole 23, and a nozzle plate 11 in which a plurality of nozzles 25 is formed. In addition, the elastic plate 27 is joined to one surface of the flow path forming substrate 26, that is, the surface of the case side, and the nozzle plate 11 is joined to the other surface of the flow path forming substrate 26, that is, the surface of an opposite side of the elastic plate joining surface. The configuration of the nozzle plate 11 will be described later.

The elastic plate 27 has a double structure in which an elastic body film 30 is stacked over the surface of a support plate 29. In the present embodiment, a stainless steel plate, which is a kind of metallic plate, is formed as the support plate 29, whereby the elastic plate 27 is produced using a complex plate material in which a resin film made of PPS (polyphenylene sulfide) or PI (polyimide) is laminated on the surface of the support plate 29 as the elastic body film 30. In the elastic plate 27, a diaphragm portion which varies the volume of the pressure chamber is provided. Furthermore, in the elastic plate 27, a compliance portion which seals a part of a common liquid chamber 40 is provided.

The diaphragm portion is produced by partially removing the support plate 29 through an etching machining process or the like. That is, the diaphragm portion includes an island portion 31 to which the front end surface of the piezoelectric vibrator 19 is joined, and a thin elastic portion 32 surrounding the island portion 31. The compliance portion is a portion for absorbing the pressure fluctuation of the liquid stored in the common liquid chamber 40. The damper portion is also produced by removing the support plate 29 of the area facing the opening surface of the storing space portion through etching machining or the like to leave only the elastic body film 30.

Furthermore, since the front end surface of the piezoelectric vibrator 19 is joined to the island portion 31, the volume of the pressure chamber can be varied by stretching the free end portion. For example, when the piezoelectric vibrator 19 is charged to contract the free end portion in the element length direction, the island portion 31 is extended. As a result, the island portion 31 is moved, whereby the volume of the pressure chamber can be increased as compared to the discharging state of the piezoelectric vibrator 19. Moreover, when the piezoelectric vibrator 19 of the charged state is discharged to stretch the free end portion in the element length direction, the island portion 31 is pushed to the pressure chamber 24 side. As a result, the volume of the pressure chamber can be reduced as compared to the charged state of the piezoelectric vibrator 19.

A supply needle unit 33 is provided in the cartridge mounting portion 2. The supply needle unit 33 is a portion connected to a liquid cartridge 34 (a kind of liquid supply source) in which liquid is stored, and the liquid stored in the liquid cartridge 34 is supplied into the recording head 3 via the supply needle unit 33. In addition, as the liquid supply source, a liquid storage pack (a storage body in which liquid is stored) may be used without being limited to the liquid cartridge 34.

Furthermore, it is also possible to adopt a configuration in which a liquid supply source such as the liquid cartridge 34 is disposed at the main body side of the printer 1 and ink is supplied from the liquid supply source through the ink supply tube to the recording head 3.

The supply needle unit 33 in the present embodiment is roughly constituted by a liquid supply needle 35 and a needle holder 36. The liquid supply needle 35 is a member that is inserted into the inner portion of the liquid cartridge 34, and introduces the liquid, which was stored in the liquid cartridge 34, into the needle. The front end portion of the liquid supply needle 35 is sharpened in a conical shape, and a plurality of liquid introduction holes extending between the inside and outside the needle are formed. The needle holder 36 is a member for attaching the liquid supply needle 35, and the surface thereof is formed with a pedestal 37 for fixedly attaching a root portion of the liquid supply needle 35.

The supply needle unit 33 is disposed on the attachment surface of the case 16. In the disposition state, a liquid outlet and the connection protrusion of the case 16 communicate with each other via a packing 38 in a liquid-tight state. In addition, at the inside of the connection protrusion, a liquid supply path 39 passing through the case 16 is formed. The liquid supply path 39 communicates with the common liquid chamber 40 of the flow path unit 17. Thus, the liquid stored in the liquid cartridge 34 flows in the common liquid chamber 40 through the liquid supply path 39.

In the recording head 3 and the supply needle unit 33, there is formed a series of liquid flow paths that lead from the liquid supply needle 35 through the common liquid chamber 40 and the pressure chamber 24 to the nozzle 25. In addition, upon operating the piezoelectric vibrator 19, the volume of the pressure chamber can be changed as described above. By the fluctuation in the volume of the pressure chamber, the pressure fluctuation occurs in the liquid within the pressure chamber 24, and thus, the liquid pressure in the pressure chamber 24 can be changed, whereby the liquid droplets can be ejected from the nozzle 25. For example, when the piezoelectric vibrator 19 is charged to expand the pressure chamber 24 and then the piezoelectric vibrator 19 is rapidly discharged to contract the pressure chamber 24, the liquid flowed in the pressure chamber 24 is rapidly pressurized by the expansion of the pressure chamber 24 and the liquid droplets are ejected from the nozzle 25.

As the ink ejected from the printer 1, for example, a pigment ink is used. The ink is regulated so that a pigment concentration, a moisturizer concentration or the like is suitable for the application of the image printing or the like. In addition, in the present embodiment, a total of 6 ink colors of black ink (K), cyan ink (C), magenta ink (M), yellow ink (Y), white ink (W), and silver ink (S) are used. As these inks, it is desirable to use an ultraviolet curable ink (a UV ink: a kind of photo curable liquid). The ultraviolet curable ink is different from a normal water-based ink in that, after landing the ink on the recording medium (an object to be landed), by irradiating the ultraviolet rays from an ultraviolet irradiation unit (not shown) with respect to the landing position to cure the ink, a stable printing quality can be secured without being influenced by the physical property of the recording medium such as the ink permeability.

Herein, the white ink is an ink that contains a white-based pigment, and is an example of the white-based liquid in the invention. As the white-based pigment, for example, titanium dioxide can be suitably used. Furthermore, the silver ink is an ink including the gloss-based pigment and a kind of the gloss-based liquid in the invention. As the gloss-based pigment, for example, it is possible to use a metal pigment in the form of a powder or in the form of paste formed of a metal such as aluminum, and a pearl pigment formed of mica titanium or the like in which the surface of mica is coated with a metal oxide. The clear ink is an ink that does not include the color material (namely, is not positively colored) and, on the other hand, includes the transparent resin pigment and through which the light penetrates, and a kind of a translucent clear liquid in the present invention. The printer 1 is configured so that a special visual effect can be obtained in the recording image using the white ink or the silver ink. This point will be described later.

Next, an allocation of each color of ink to the nozzle row will be described.

Figure 3:
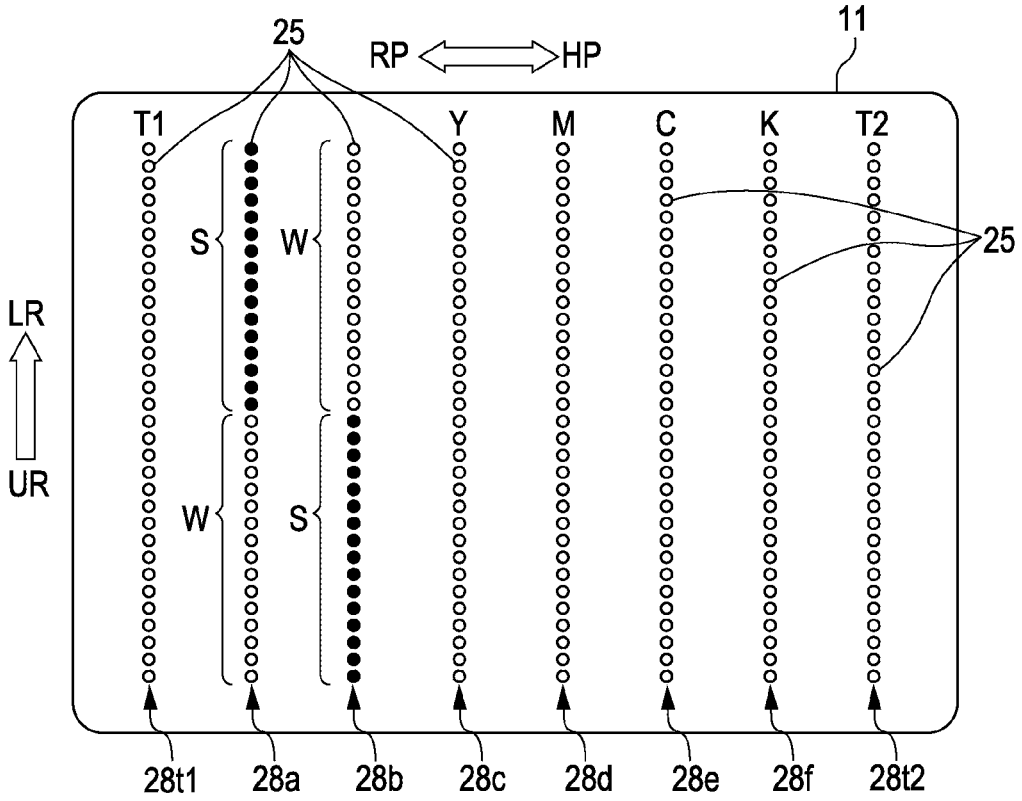
FIG. 3 is a schematic diagram that illustrates an arrangement of a nozzle row according to an aspect of the invention.

FIG. 3 is a top plan view that explains the configuration of the nozzle plate 11. In FIG. 3, a left and right direction is a main scanning direction, a right side thereof is a home position side (HP), and a left side thereof is a recording area side (RP). Furthermore, an up and down direction in FIG. 3 is a sub-scanning direction (a transportation direction of the recording paper 6), a lower side thereof is an upstream side (UR), and an upper side is a downstream side (LR). The nozzle plate 11 is a thin plate formed of the metal or the like in which a plurality of nozzles 25 is formed in a pitch corresponding to the dot formation density. In the nozzle plate 11 in the present embodiment, a plurality of nozzles 25 is provided in rows in a direction equivalent to the sub-scanning direction to constitute each nozzle row 28*a*-28*f*, whereby a plurality of nozzle rows 28*a*-28*f* is formed in a direction equivalent to the main scanning direction. In the present embodiment, eight rows of nozzle rows 28*a*-28*f* are formed. Each nozzle row 28*a*-28*f* is formed of 360 nozzles 25 that are opened, for example, by the pitch corresponding to 360 dpi.

In the present embodiment, a first nozzle row 28*a* corresponding to the white ink (W) and the silver ink (S), a second nozzle row 28*b* corresponding to the white ink (W) and the silver ink (S), a third nozzle row 28*c* corresponding to the yellow ink (Y), a fourth nozzle row 28*d* corresponding to the magenta ink (M), a fifth nozzle row 28*e* corresponding to the cyan ink (C), and a sixth nozzle row 28*f* corresponding to the black ink (K) are formed in rows in the direction corresponding to the main scanning direction. Furthermore, at the front (at a side which first performs the ejection) at the time of scanning the forward pass in the main scanning direction from the first nozzle row 28*a*, a seventh nozzle row 28*t*1 corresponding to a first clear ink (T1) is formed, and in the rearmost portion of each nozzle row in the rear at the time of scanning the forward pass in the main scanning direction from the second nozzle row 28*b*, an eighth nozzle row 28*t*2 corresponding to a second clear ink (T2) is formed. That is, in the movement of the recording head 3 in the main scanning direction, the nozzle rows 28*t*1 and 28*t*2 of the clear ink are configured so as to become the foremost row and the rearmost row in both reciprocating direction.

Moreover, there is a relative positional relationship in which, at the time of scanning using the forward pass of the recording head 3 in the main scanning direction of the recording head 3, the first nozzle row 28*a* becomes the front side (from which ink is first ejected), and the second nozzle row 28*b* becomes the rear side. On the other hand, at the time of the returning pass, the second nozzle row 28*b* becomes the front side and the first nozzle row 28*a* becomes the rear side.

The first nozzle row 28*a* is divided into two nozzle groups including the nozzle group (shown by black circles in the drawing) of an upstream side half (180) in the sub-scanning direction and the nozzle group of a downstream side half (180) in the same direction, and the liquid flow paths of both nozzle groups are also separated from each other. In addition, it is configured so that the nozzle group disposed at the upstream side ejects the white ink (W), and the nozzle group disposed at the downstream side ejects the silver ink (S). Thus, the nozzle group of the upstream side of the first nozzle row 28*a* is equivalent to the white-based correspondence nozzle group and the downstream nozzle group thereof is equivalent to the gloss-based correspondence nozzle group.

Similarly, the second nozzle row 28*b* is configured so that the nozzle group disposed at the upstream side ejects the silver ink (S) and the nozzle group (shown by black circles in the drawing) disposed at the downstream side ejects the white ink (W). The nozzle group of the upstream side of the second nozzle row 28*b* is equivalent to the gloss-based correspondence nozzle group, and the downstream side nozzle group thereof is equivalent to the white-based correspondence nozzle group. In addition, the first nozzle row 28*a* and the second nozzle row 28*b* are disposed in the state of being adjacent to each other without other nozzle rows being disposed therebetween. This arrangement is caused by the fact that after ejecting the silver ink, the white ink is ejected to and landed on the landing position of the silver ink in the present embodiment, as is described more fully below.

Figure 4:
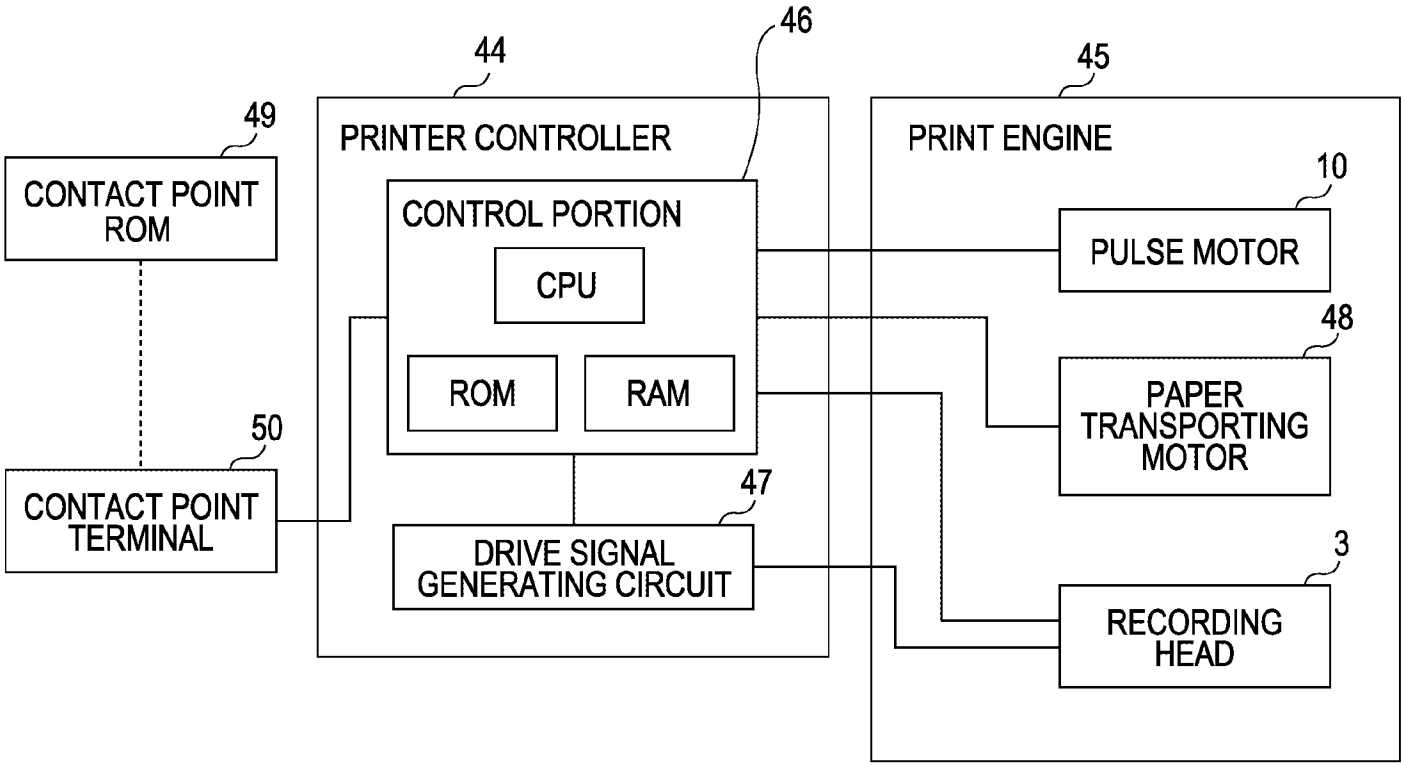
FIG. 4 is a block diagram that illustrates an electric configuration of a printer according to an aspect of the invention.

Next, the electric configuration of the printer 1 will be described. As shown in FIG. 4, the printer 1 is roughly constituted by a print controller 44 and a print engine 45.

The print controller 44 includes a control portion (a kind of control unit) including a CPU, a ROM and a RAM, a drive signal generating circuit 47 (a kind of drive signal generating unit) that generates the drive signal for supplying to the recording head 3 or the like. On the other hand, the print engine 45 includes a pulse motor 10 (a kind of relative movement unit), a paper transporting motor 48 (a kind of landing object transporting unit), and the recording head 3 or the like. In addition, the operations of the respective portions can be controlled by the control portion 46.

The control portion 46 is a portion that performs the control in the printer 1. The control portion 46 is electrically connected to a contact point terminal 50, and thus it is possible to read various pieces of information stored in a contact point ROM 49 of the mounted liquid cartridge 34. For this reason, the control portion 46 can recognize the type or the like of ink stored in the liquid cartridge 34 based on the read information. Furthermore, the control portion 46 can redraft various pieces of information stored in the contact point ROM 49.

The control portion 46 creates the dot pattern data for controlling the recording head 3 based on the print data that is transmitted from an external apparatus such as a host computer. In addition, the control portion 46 transmits the created dot pattern data to the recording head 3. Furthermore, the control portion 46 also serves as a drive signal setting unit, sets the drive signal of the waveform suitable for the printing the image or the like, and generates the drive signal from the drive signal generating circuit 47. In addition, the control portion 46 operates the pulse motor 10 to move the carriage 4 (the recording head 3) to a desired position or operates the paper transporting motor 48 to deliver the recording paper 6.

Figure 5:
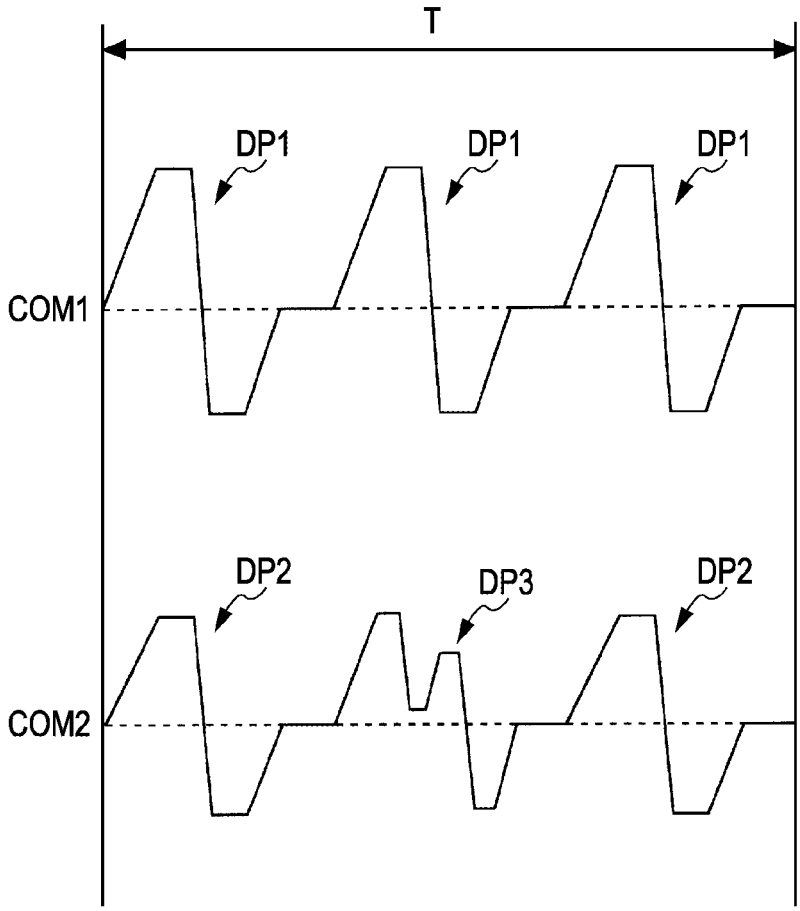
FIG. 5 is a diagram that illustrates a drive signal generated from a drive signal generating circuit according to an aspect of the invention.

The drive signal generating circuit 47 is a portion that serves as the drive signal generating unit, and generates the drive signal for supplying to the recording head 3 under the control by the control portion 46. As shown in FIG. 5, the drive signal generating circuit 47 of the present embodiment can concurrently generate two types of drive signals COM1 and COM2.

Hereinafter, each drive signal will be described. The first drive signal COM1 is a series of signals that include three first drive pulses DP1, which are set so as to enlarge the ejection volume of the liquid droplet as much as possible within a unit period that is a repeating period of the drive signal and is divided into a timing signal such as a latch pulse at equal distances. The first drive pulse DP1 is a drive pulse which sets the drive voltage, that is, the electric potential difference between a maximum electric potential and a minimum electric potential as high as possible to an extent that is allowable by the piezoelectric vibrator 19. In addition, whenever the first drive pulse DP1 is supplied to one piezoelectric vibrator 19, the maximum ink droplet volume is ejected from the nozzle 25. In the present embodiment, in a case where the white ink is mainly ejected, the first drive pulse DP1 is used.

As shown in FIG. 5, the second drive signal COM2 is a series of signals that includes two second drive pulses DP2 within one unit period and includes a third drive pulse DP3 between both second drive pulses DP2. The second drive pulse DP2 is a drive pulse which is set so that the ejected ink droplet volume becomes smaller than the case of the first drive pulse DP1, and the basic waveform shape thereof is the same as that of the first drive pulse DP1. More particularly, the second drive pulse DP2 is different from the first drive pulse DP1 in that the drive voltage is set to be lower than that of the first drive pulse DP1. In the present embodiment, in a case of ejecting the silver ink or the color ink, the second drive pulse DP2 is used. In addition, the third drive pulse DP3 is a drive pulse, in which the configuration of the drive voltage or the waveform element is set so that the ejected ink droplet volume is minimized, and is mainly used in the case of ejecting the clear ink.

Next, in the printer 1 having the configuration as mentioned above, the printing process using the silver ink, the white ink, and the clear ink will be described. In this printing process, the white ink is ejected onto the recording medium such as the recording paper 6 before the printing the recorded recording medium is performed, such that the white ink layer is used as a base (a kind of the base layer in the invention), and then, the silver ink is ejected onto the white ink layer to form the silver ink layer (a kind of the intermediate layer in the invention) in an overlapping manner, and the clear ink is ejected thereon to form the clear ink layer (a kind of epidermal layer in the invention). As a result, a so-called beta printing in which a predetermined area of the recording medium is embedded with ink without gaps is performed.

When the power supply is turned on, the control portion 46 carries out a predetermined initializing operation. In the initializing operation, the carriage 4 is operated in the main scanning direction, thereby performing the position recognition of the carriage 4 (the recording head 3) or the like, or clearing unnecessary information within the work area. If the initializing operation has been performed, the control portion 46 controls the pulse motor 10 or the paper transporting motor 48, thereby moving the carriage 4 in the main scanning direction (the relative movement direction) and delivering the recording paper 6 in the sub-scanning direction (the transportation direction). In addition, the control portion 46 controls the supply of the first drive pulse DP1, the second drive pulse DP2, and the third drive pulse DP3 to the piezoelectric vibrator 19 in synchronization with the movement of the carriage 4 or the recording paper 6.

Figure 6A:
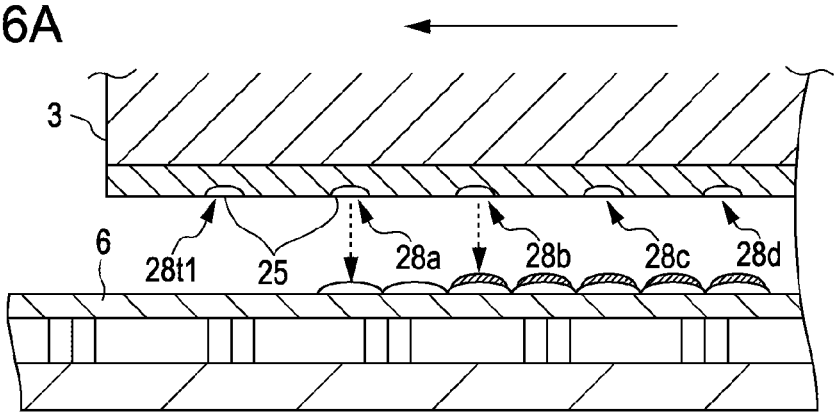
FIG. 6A to 6C are schematic diagrams that illustrates a form of printing process
Figure 6B:
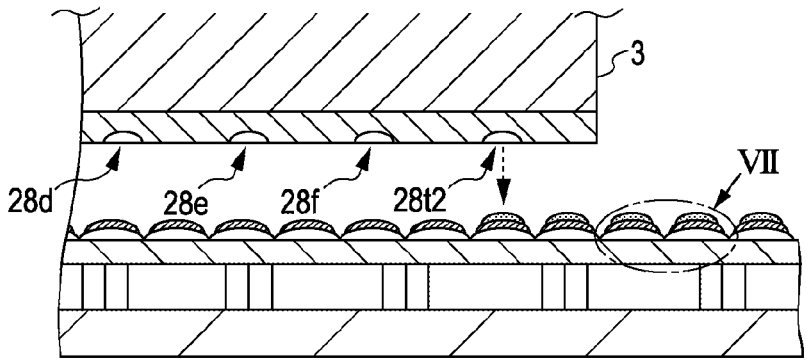
Figure 7:
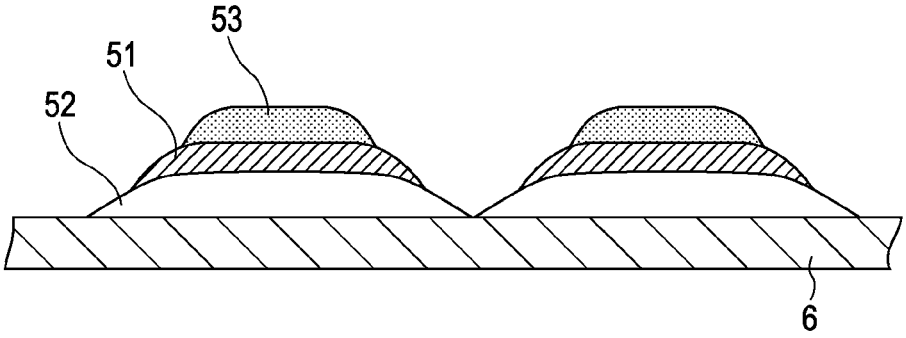
FIG. 7 is an enlarged view of an area VII in FIG. 6B according to an aspect of the invention.
Figure 8:
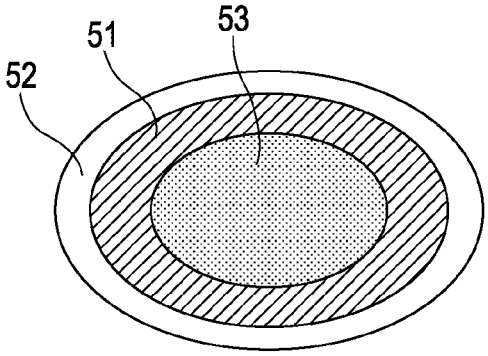
FIG. 8 is a top plan view that illustrates configurations of a base layer, an intermediate layer, and an epidermal layer according to the invention.

FIGS. 6A and 6B are schematic diagrams that explain the forms of the printing process (the recording process) in the forward pass direction (equivalent to a first relative movement direction) in which the recording head 3 performs the ejection of ink from the nozzle 25 while moving from one home position side in the main scanning direction to the other side thereof. Furthermore, FIG. 7 is an enlarged view of an area VII in FIG. 6B, and FIG. 8 is a top plan view of the landing shapes of each ink shown in FIG. 7.

As shown in FIG. 6A, in the forward pass, the white ink is ejected from the white-based correspondence nozzle group (W) disposed at the upstream side of the first nozzle row 28*a* in the sub-scanning direction by the first drive pulse DP1 and lands on a predetermined position of the recording paper 6. As a result, the white ink layer 52 is first formed on the recording paper 6. Then, at the timing when the recording head 3 is moved by the amount of the gap of the adjacent nozzle rows, the silver ink is ejected from the gloss-based correspondence nozzle group disposed at the upstream side of the second nozzle row 28*b* in the sub-scanning direction by the second drive pulse DP2 and lands on the white ink layer 52 that was previously formed. As a result, the silver ink layer 51 is formed on the white ink layer 52 in an overlapping manner. In addition, as shown in FIG. 6B, at the time when the silver ink is ejected from the second nozzle row 28*b* and then the recording head 3 is moved by five nozzle rows, the clear ink is ejected from a colorless transparent correspondence nozzle group (the nozzle group of the upstream side half in the sub-scanning direction) of the eighth nozzle row 28*t*2 by the third drive pulse DP3 and is landed on the silver ink layer 51. As a result, as shown in FIGS. 7 and 8, the clear ink layer 53 is formed over the silver ink layer 51 on the white ink layer 52 in an overlapping manner. In this manner, the printing process of the forward pass is performed while sequentially ejecting the white ink, the silver ink and the clear ink from the recording head 3. As a result, a multilayer dot formed of the white ink layer 52, the silver ink layer 51, and the clear ink layer 53 is arranged in the main scanning direction, whereby a multilayer dot group is formed.

Furthermore, the first nozzle row 28*a*, the second nozzle row 28*b*, and the eighth nozzle row 28*t*2 are disposed in relatively the same position in the main scanning direction. For example, it is impossible to adopt an arrangement in which the nozzle pitch of the second nozzle row 28*b* or the eighth nozzle row 28*t*2 deviates from the nozzle pitch of the first nozzle row 28*a* by a half pitch.

Figure 6C:
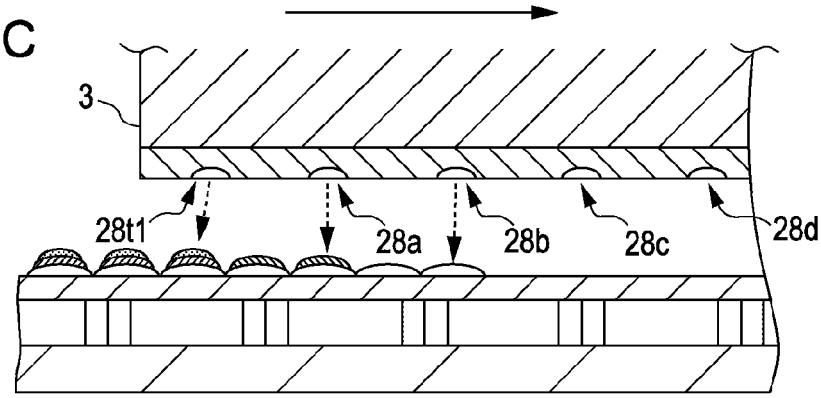

FIG. 6C is a schematic diagram that explains the form of the printing process in the returning pass direction (equivalent to a second relative movement direction) in which the recording head 3 performs the ejection of ink from the nozzle 25 while moving from the other side in the main scanning direction to one home position side thereof. When the printing process of the forward pass is finished, the recording paper 6 is transported to the downstream side of the sub-scanning direction by half a nozzle row, that is, the distance corresponding to the length of one nozzle group through the operation of the paper transporting motor 48, and then the printing process of the returning pass is performed. As shown in FIG. 6C, in the returning pass, the white ink is ejected from the white-based correspondence nozzle group (S) disposed at the downstream side of the second nozzle row 28*b* in the sub-scanning direction by the first drive pulse DP1, and is landed on a predetermined position of the recording paper 6, whereby the white ink layer 52 is formed. Then, at the time when the recording head 3 is moved by the gap of the adjacent nozzle rows, the silver ink is ejected from the gloss-based correspondence nozzle group disposed at the downstream side of the first nozzle row 28*a* in the sub-scanning direction by the second drive pulse DP2 and is landed on the white ink layer 52 that was previously formed. As a result, in the same manner as the forward pass, the silver ink layer 51 is formed on the white ink layer 52 in an overlapping manner. In addition, at the timing when the silver ink is ejected from the first nozzle row 28*a* and then the recording head 3 is moved by the gap of the adjacent nozzle rows, the clear ink is ejected from a colorless transparent correspondence nozzle group (the nozzle group of the downstream side half in the sub-scanning direction) of the seventh nozzle row 28*t*1 by the third drive pulse DP3 and is landed on the silver ink layer 51. As a result, as shown in FIGS. 7 and 8, the clear ink layer 53 is formed so as to overlap over the silver ink layer 51 on the white ink layer 52. In this manner, the printing process of the returning pass is performed while sequentially ejecting the white ink, the silver ink and the clear ink from the recording head 3. As a result, a multilayer dot formed of the white ink layer 52, the silver ink layer 51, and the clear ink layer 53 is arranged in the main scanning direction, whereby a multilayer dot group is formed.

In this manner, by performing the printing process while sequentially ejecting the white ink, the silver ink and the clear ink in the forward pass and the returning pass, the ground color of the recording medium such as the recording paper 6 is covered by the white ink layer 52 and is concealed and the silver ink layer 51 is formed thereon using the white ink layer 52 as a base, and thus, the brightness of the silver ink layer 51 can be increased as compared to the case of directly forming the silver ink layer 51 on the landing object. As a result, the metallic glossy feel of the silver ink layer 51 can be further accentuated, and in addition, the clear ink layer 53 made of the clear ink is formed on the white ink layer 52 and the silver ink layer 51 in an overlapping manner, whereby it is possible to generate a unique glossy feel with the depth, e.g., a pearl-like glossy feel, by the reflection of the light in the clear ink layer 53 and the reflection of the metallic light in the silver ink layer 51 at the inner part of the clear ink layer 53, and give the recording image a shine, thereby further accentuating the glossy feel.

In the present embodiment, since the first drive pulse DP1 and the second drive pulse DP2 can be used separately so that the ink droplet volume when the white ink is ejected becomes larger than that when the silver ink is ejected, the area covered by the white ink layer 52 becomes greater than that of the silver ink layer 51. As a result, the ground color of the recording medium is more reliably concealed by the white ink layer 52 and the outer periphery of the silver ink layer 51 is not formed at the outside from the outer periphery of the white ink layer. Thus, since the glossy feel is further emphasized, the glossy feel of the silver ink layer 51 can be further accentuated. In addition, even if, particularly, the recording medium is a resin film or the like through which light is transmitted, by the concealment action of the white ink layer 52 being the base, the coloring properties of various inks to be formed thereon can be secured.

Furthermore, since the volume of the landing liquid of the clear ink is set so as to become smaller than that of the white ink and that of the silver ink, a portion, in which the clear ink layer 53 is not formed with respect to the white ink layer 52 and the silver ink layer 51, is generated. That is, the clear ink layer 53 is scattered in the recording image. As a result, the portion with the clear ink layer 53 formed thereon can obtain the glossy feel due to the clear ink layer 53, and on the other hand, the portion without the clear ink layer 53 formed thereon comes to have the metallic gloss in which the glossy feel is suppressed compared to the portion with the clear ink layer 53 formed thereon. As a result, it is possible to obtain the unique glossy feel, e.g., the pearl-like glossy feel or the glossy feel, in which a lame is engraved, in the recording image or the like.

Next, a second embodiment will be described.

Figure 9:
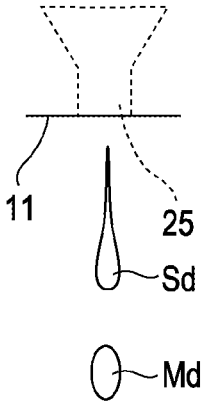
FIG. 9 is a schematic diagram that explains a form in which a clear ink is ejected from a nozzle in a second embodiment according to the invention.
Figure 10:
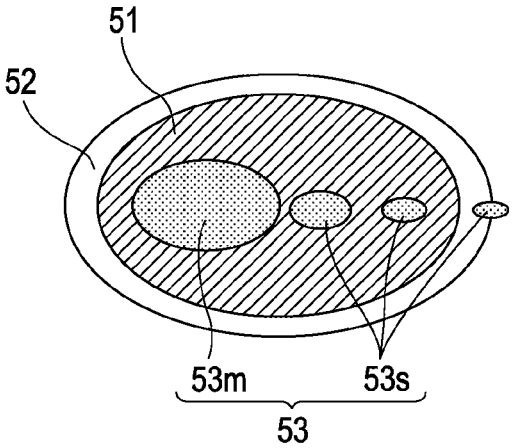
FIG. 10 is a top plan view that explains configurations of a base layer, an intermediate layer, and an epidermal layer in a second embodiment.

The present embodiment is different from the first embodiment in that the third drive pulse DP3 used in the ejection of the clear ink is set so that it can heighten the projectile velocity of the ejected clear ink compared to the case of the first embodiment, whereby the satellite liquid droplet is intentionally generated when the clear ink is ejected. Since the remaining configurations are the same as those of the first embodiment, the descriptions thereof will be omitted. In order that the satellite liquid droplet may be generated when the clear ink is ejected by the third drive pulse DP3, for example, this can be realized by making the change in electric potential of the third drive pulse DP3 steeper than the case of the first embodiment. When the clear ink is ejected by the third drive pulse DP3, as shown in FIG. 9, it is possible to generate a satellite liquid droplet Sd that is separated from a main liquid droplet Md of the clear ink and flies off. As a result, when the liquid droplet group is landed on the white ink layer 52 and the silver ink layer 51 that are formed on the recording medium in advance, as shown in FIG. 10, a plurality of clear ink layers 53 is formed. The clear ink layers 53 are formed of a circular or an oval main clear dots 53*m* that are formed by the landing of the main liquid droplet, and one or a plurality of satellite clear dots 53*s* that are formed by the deviated landing of the satellite liquid droplet, which was separated from the main liquid droplet, from the landing position of the main clear dot 53*m* to the rear side of the head movement direction. That is, a plurality of clear ink droplets are landed with respect to one landing position of the white ink layer 52 and the silver ink layer 51. By this configuration, it is possible to further emphasize the glossy feel in which the lame is engraved in the recording image.

The invention is not limited to the above-mentioned embodiments, but can be variously modified based on the description of the claims.

For example, in each embodiment, the configuration, in which the metallic texture is accentuated by forming the silver ink layer 51 on the white ink layer 52 as the base, has been indicated, but, on the contrary to this, the white color can be accentuated by forming the white ink layer 52 on the silver ink layer 51 as the base, without being limited thereto. In this case, as the drive pulse used in forming the silver ink layer 51, the pulse, in which the liquid droplet volume upon being discharged increases the most among the first drive pulse DP1, the second drive pulse DP2 and the third drive pulse DP3, and on the other hand, the pulse which becomes one large ink layer upon being landed, is selected. Specifically, the first drive pulse DP1 shown in the first embodiment is used. Furthermore, in regard to the white ink layer 52, the second drive pulse DP2 may be selected. Even in this configuration, the clear ink layer 53 is formed on the silver ink layer 51 and the white ink layer 52 in an overlapping manner, whereby it is possible to further increase the shine, thereby further accentuating the glossy feel.

Moreover, in each embodiment, the configuration in which the area covered by the clear ink layer 53 upon being landed is smaller than that of other ink layers has been described, the clear ink layer 53 may be formed to have a covering area wider than the intermediate layers (the silver ink layer 51 or the white ink layer 52), without being limited thereto. At that time, the area covered by the clear ink layer 53 is not greater than that of the base layer (e.g., the white ink layer 52). If the area covered by the clear ink layer 53 is greater than that of the base layer, the following harmful effects may occur.

Since no ink layer is formed in an area further outside the base layer, that is, the absorptiveness of liquid to the ejecting medium is larger than that of the area in which the ink layer is formed in advance, in the area where none of the ink layers is formed, an action in which the ink tries to further spread is generated. For that reason, upon forming the clear ink layer at the outside from the base layer, the outer periphery of the base layer permeates the clear ink layer 53 and spreads. As a result, the pigment component within the base layer is moved to the outer periphery side and is scattered, whereby the intermediate layer, e.g., all the white ink layers become dim. In addition, there is sufficient concentration of the base layer, whereby the aim of accentuating the intermediate layer is not accomplished. Thus, the area covered by the clear ink layer needs to be within the range of the area covered by the base layer.

Herein, as the drive pulse used in this embodiment, if the first drive pulse DP1 is selected for the base layer and the second drive pulse DP2 is selected for the intermediate layer, the drive pulse used for the clear ink layer may be the first drive pulse DP1, but, of course, may use a new drive pulse DP4 in which the voltage becoming the middle value between the liquid droplet volume of the DP1 and the liquid droplet volume of the DP2 may be set.

In each embodiment, the description has been given of the configuration in which the recording head 3 (the carriage 4 with the same mounted thereon) is relatively moved with respect to the recording medium of the stationary state in the reciprocating printing process in the main scanning direction, but the invention is not limited thereto. For example, it is also possible to adopt a configuration in which the recording medium is relatively moved with respect to the recording head 3 in the state in which the position of the recording head 3 is fixed.

Moreover, in the above-mentioned embodiment, the invention was described using one recording head 3, which includes for example, the first nozzle row 28*a* corresponding to the white ink (W) and the silver ink (S), the second nozzle row 28*b* corresponding to the white ink (W) and the silver ink (S), the third nozzle row 28*c* corresponding to the yellow ink (Y), the fourth nozzle row 28*d* corresponding to the magenta ink (M), the fifth nozzle row 28*e* corresponding to the cyan ink (C), the sixth nozzle row 28*f* corresponding to the black ink (K), the seventh nozzle row 28*t*1 corresponding to the first clear ink (T1), and the eighth nozzle row 28*t*2 corresponding to the second clear ink (T2) are formed so as to be arranged in the direction corresponding to the main scanning direction.

Other variations may be made wherein, for example, the recording head in which the first nozzle row 28*a* corresponding to the white ink (W) and the silver ink (S), and the second nozzle row 28*b* corresponding to the white ink (W) and the silver ink (S) are provided and the recording head with the nozzle rows of other colors provided therein may be individually provided without being limited to this form. In addition, the recording head with the first nozzle row 28*a* corresponding to the white ink (W) and the silver ink (S) provided therein and the recording head with the second nozzle row 28*b* corresponding to the white ink (W) and the silver ink (S) provided therein may be separated from each other, and the "recording head" and the "liquid ejection head" of the invention are interpreted as collectively expressing that a plurality of recording heads (the liquid ejection heads) is provided. In either case, the nozzle row corresponding to the clear ink is disposed at both end sides of each recording head in the main scanning direction.

Furthermore, the drive signal for driving the piezoelectric vibrator 19 and the drive pulse included therein are not limited to those indicated in the above-mentioned embodiment, but can adopt an arbitrary configuration.

In addition, the example described above is an ink jet type recording printer. However, the invention is not limited thereto. The invention can be applied to other liquid ejection apparatuses, for example, a color material ejection apparatus used in manufacturing a color filter of a liquid crystal display or the like, an electrode material ejection apparatus used in forming the electrode of an organic EL display, a FED or the like, and a vital organic matter ejection apparatus or the like used in manufacturing a bio chip, if they have a configuration which lands two kinds of liquids on the landing object in an overlapping manner.

What is claimed is:

1. A liquid ejecting method comprising:

ejecting one liquid of a white-based liquid or a gloss-based liquid from a liquid ejecting head, the one liquid being ejected to a landing object to form a base layer;

ejecting the other liquid of the white-based liquid or the gloss-based liquid from the liquid ejecting head on the base layer to form an intermediate layer; and ejecting a translucent clear liquid from the liquid ejecting head on the intermediate layer to form an epidermal layer, wherein an ejection volume of the translucent clear liquid ejected from the liquid ejecting head is smaller than that of the one liquid of the white-based liquid or the gloss based liquid.

2. The liquid ejecting method according to claim 1, wherein the ejection volume of the translucent clear liquid is smaller than that of the other liquid of the white-based liquid or that of the gloss-based liquid.

3. The liquid ejecting method according to claim 2, wherein an ejection volume of the other liquid of the white-based liquid or a gloss-based liquid is smaller than that of the one liquid of the white-based liquid or the gloss-based liquid.

4. The liquid ejecting method according to claim 1, wherein the ejection volume of the translucent clear liquid is larger than that of the other liquid of the white-based liquid or the gloss-based liquid.

5. The liquid ejecting method according to claim 1, wherein a plurality of liquid droplets of the translucent clear liquid are ejected with respect to a single liquid droplet of the other liquid of the white-based liquid or the gloss-based liquid.

6. A liquid ejecting method comprising:

ejecting one liquid of a white-based liquid or a gloss-based liquid from a liquid ejecting head to a landing object;

ejecting the other liquid of the white-based liquid or the gloss-based liquid from the liquid ejecting head on the one liquid of the white-based liquid or the gloss-based liquid landing on the landing object; and ejecting a translucent clear liquid from the liquid ejecting head on the other liquid of the white-based liquid or the gloss-based liquid;

wherein an ejection volume of the translucent clear liquid ejected from the liquid ejecting head is smaller than that of the one liquid of the white-based liquid or the gloss-based liquid.

7. The liquid ejecting method according to claim 6, wherein the ejection volume of the translucent clear liquid is smaller than that of the other liquid of the white-based liquid or the gloss-based liquid.

8. The liquid ejecting method according to claim 7, wherein an ejection volume of the other liquid of the white-based liquid or a gloss-based liquid is smaller than that of the one liquid of the white-based liquid or the gloss-based liquid.

9. The liquid ejecting method according to claim 6, wherein the ejection volume of the translucent clear liquid is larger than that of the other liquid of the white-based liquid or the gloss-based liquid.

10. The liquid ejecting method according to claim 6, wherein a plurality of liquid droplets of the translucent clear liquid are ejected with respect to a single liquid droplet of the other liquid of the white-based liquid or the gloss-based liquid.

* * * * *